US008302894B2

(12) United States Patent
Mercuri et al.

(10) Patent No.: US 8,302,894 B2
(45) Date of Patent: Nov. 6, 2012

(54) EXTERNAL COVER FOR A SPOOL OF THREAD TO PREVENT THREAD FROM FREELY COMING OFF AS THE SPOOL IS BEING USED

(75) Inventors: Ennio Mercuri, Holden Hill (AU); Gervasio Mercuri, Holden Hill (AU)

(73) Assignee: Merctech Pty Ltd, Holden Hill (AU)

( * ) Notice: Subject to any disclaimer, the term of this patent is extended or adjusted under 35 U.S.C. 154(b) by 26 days.

(21) Appl. No.: 12/438,935

(22) PCT Filed: Aug. 30, 2007

(86) PCT No.: PCT/AU2007/001261

§ 371 (c)(1), (2), (4) Date: Dec. 8, 2009

(87) PCT Pub. No.: WO2008/025084

PCT Pub. Date: Mar. 6, 2008

(65) Prior Publication Data

US 2010/0108795 A1 May 6, 2010

(30) Foreign Application Priority Data

Aug. 30, 2006 (AU) ..... 2006904694

(51) Int. Cl.

| | |
|---|---|
| ***B65H 75/28*** | (2006.01) |
| ***B65H 59/22*** | (2006.01) |
| ***B65H 49/08*** | (2006.01) |
| ***B65H 57/22*** | (2006.01) |

(52) U.S. Cl. ..... 242/171; 242/172; 242/419.4; 242/566; 242/580; 242/125.3; 242/149

(58) Field of Classification Search ..... 242/128, 242/601, 171, 172, 593, 170, 416, 419, 566, 242/579, 580, 615.3, 125–125.3, 147 R, 419.4, 242/149; 53/581, 556, 585

See application file for complete search history.

(56) References Cited

U.S. PATENT DOCUMENTS

| | | | | |
|---|---|---|---|---|
| 3,672,598 | A | 6/1972 | Saveth | |
| 3,698,546 | A | 10/1972 | Kass | |
| 3,915,301 | A | 10/1975 | Gray et al. | |
| 4,348,439 | A | 9/1982 | Jones | |
| 4,460,086 | A * | 7/1984 | Davis | 206/389 |
| 6,237,866 | B1 | 5/2001 | Nagayama | |

FOREIGN PATENT DOCUMENTS

| | | |
|---|---|---|
| EP | 0 513 904 B1 | 11/1992 |

* cited by examiner

*Primary Examiner* — William E Dondero
(74) *Attorney, Agent, or Firm* — Crowell & Moring LLP

(57) ABSTRACT

The invention is a restrainer for a spool (10) of thread to prevent the thread (13) from being freely drawn off of the spool (10). It comprises a resilient element (12) that extends around the circumference of the outer surface (14) of the spool (10) so that the thread (13) being drawn from the spool (10) must pass between the outer surface of the spool (10) at the inner surface of the resilient element (12) there by impeding the free removal of the thread (13). The invention prevents excessive thread being jerked from the spool.

7 Claims, 2 Drawing Sheets

EXTERNAL COVER FOR A SPOOL OF THREAD TO PREVENT THREAD FROM FREELY COMING OFF AS THE SPOOL IS BEING USED

The present invention relates to a cover for a spool and in particular to a cover that is used to prevent the thread from freely coming off as the spool is being used.

BACKGROUND OF THE INVENTION

Spools, also known as cheeses, are most often used in machines that have some form of feed device for pulling thread from the spool. This may be done by drawing the thread upwardly off the spool or downwardly from the spool, with the spool axis either vertically aligned or at an angle to the vertical.

One problem encountered, particularly with elasticised threads is the possibility of more thread than required being drawn off so as to form a large amount of slack thread between the spool and the feed device. This can allow twists to form in the free length of thread which can in turn then jam the feed device. Also, in the case of thread being drawn upwardly from the spool, excess thread can loop under the spool and its support to thereby jam.

Clearly, this is undesirable, and the present invention is directed towards overcoming the problem.

SUMMARY OF THE INVENTION

In one aspect, the invention is a restrainer for a spool of thread to prevent the thread freely coming off the spool as it is being drawn off in use comprising an external resilient circumferential cover or element overlaying at least the end portion of the outer surface of the spool from which the thread is being drawn.

Initially, the cover or element applies a small force to the external surface of the spool which creates a drag force as thread is being withdrawn from the spool. This prevents any excessive thread being drawn from the spool which would otherwise result from the thread flicking out as it is rapidly drawn from the spool.

It is not an essential aspect of the invention that the cover or element provide a continuous force to the outer surface of the spool. As the spool reduces in diameter, the cover or element may not be providing a force to the external surface of the spool but, even though it is loosely positioned with respect to the outer surface of the spool, it will prevent excessive flick out and therefore act to impede the thread to prevent an excessive amount of thread being drawn off.

A resilient cover may comprise any stretchable circumferential cover that will apply some force to the external surface of the spool for a substantial range of diameters and may comprise woven or knitted fabric or preferably a polymeric filament net. An example of such netting is sold under the trade name Netlon. A resilient element may comprise an elastic band that is held in place.

In addition to just covering the end portion of the spool from which the thread is being drawn, the net cover may extend over the whole surface of the spool, and further, may extend partially beyond the end of the spool from which the thread is being drawn. In the latter case, the cover will extend inwardly over the end of the spool and provide an exit which is at a diameter substantially less than the maximum diameter of the spool. Although the thread will cause the cover to deflect outwardly to position adjacent to the outer surface of the spool, it does act to provide additional resistance to movement of the thread.

In another aspect, the invention is a spool of thread having an external resilient cover or element overlaying at least the end portion of the outer surface of the spool from which the thread is being withdrawn that, as the thread is drawn from the spool, prevents the thread freely coming off of the spool.

In order to fully understand the invention, a preferred embodiment will now be described, but it should be realised that the scope of the invention is not to be confined or restricted to the precise terms of this embodiment. Variations that would be readily apparent to persons skilled in the art would be considered to be within the scope of the invention.

BRIEF DESCRIPTION OF THE DRAWINGS

A preferred embodiment of the invention is illustrated in the accompanying representations in which.

DETAILED DESCRIPTION

Figure 1:
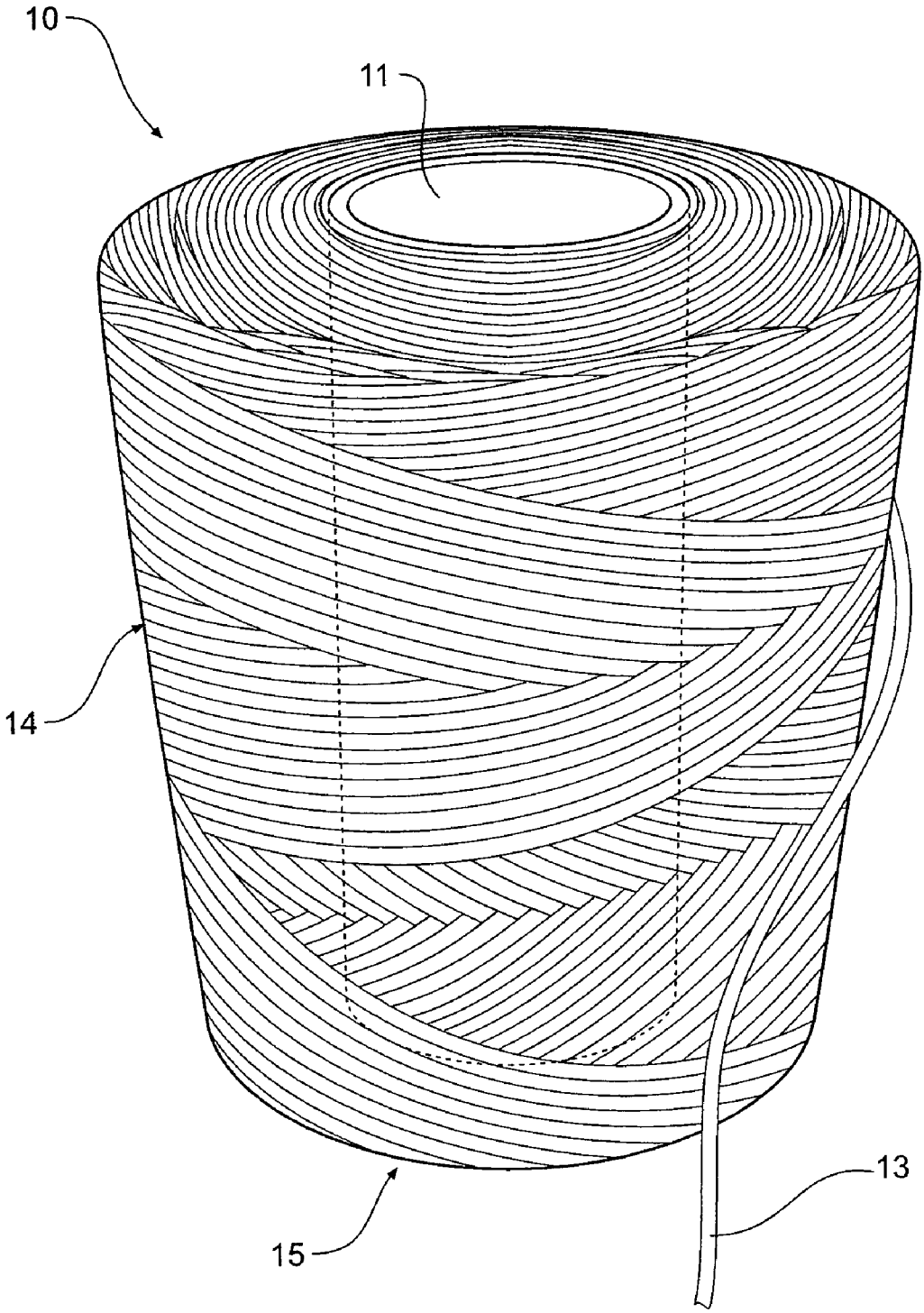
FIG. 1 shows a perspective view of a spool or cheese of thread.

Spools or cheeses of thread 10 are commonly wound onto a central support 11 as is shown in FIG. 1. The central support 11 is generally tubular in nature and can be either cylindrical or a tapered cone depending on the desired shape of the resultant spool 10. The supports 11 can be manufactured from plastic or cardboard.

Figure 2:
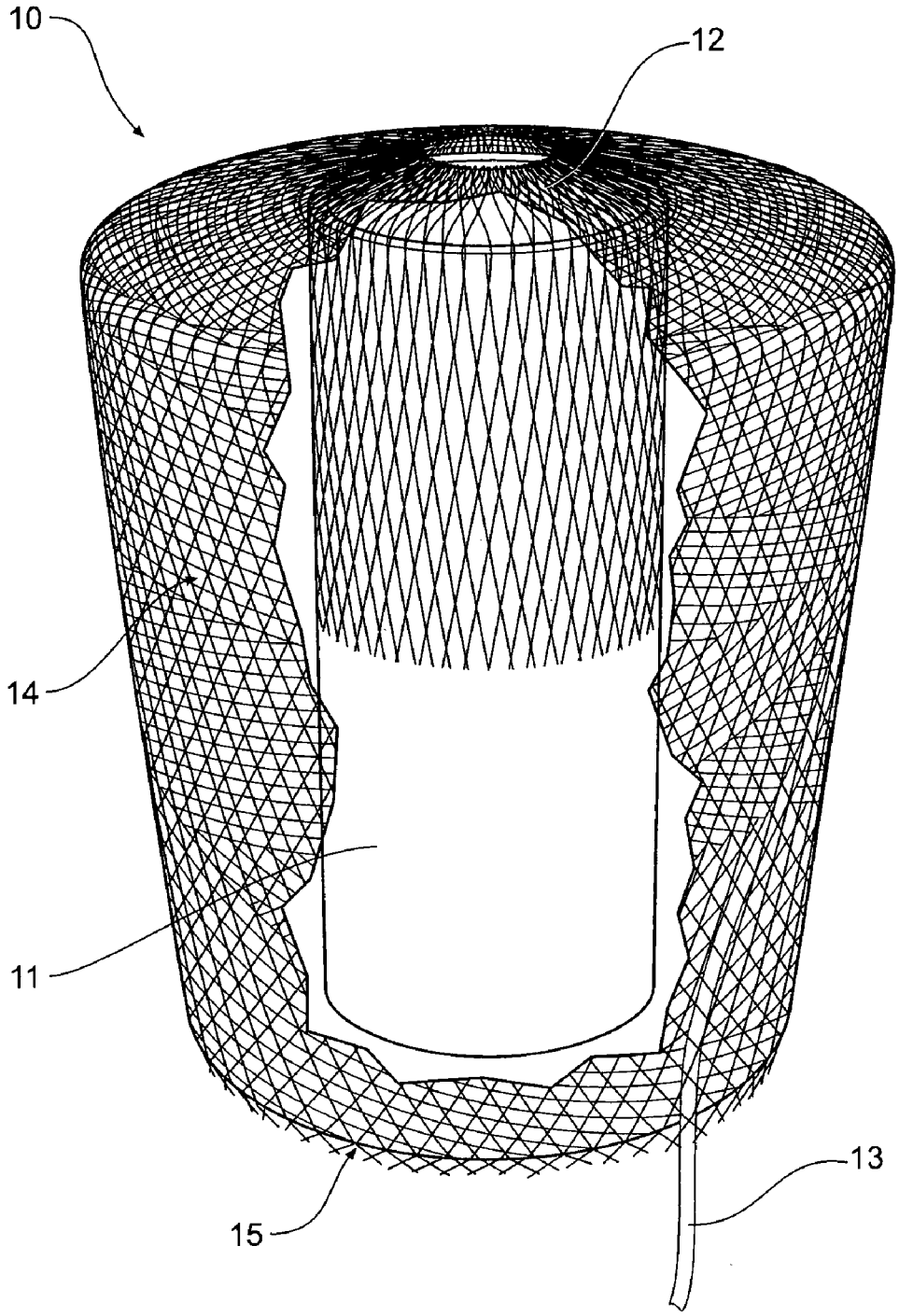
FIG. 2 is a perspective view of a restrainer according to an embodiment of the invention and positioned on a spool of the type shown in FIG. 1.

Referring now to FIG. 2, the preferred cover used in this embodiment is tubular polypropylene netting 12 that is resiliently expandable. Examples of the required netting 12 are the net products sold under the trade name Netlon.

Prior to winding the thread 13 onto the central support 11, a length of netting 12 is positioned onto the central support 11 at one end so that it extends away from the central support 11. The initial windings of thread 13 onto the central support act to hold it in place.

The thread 13 is then wound onto the central support 11 to the required diameter. The spool 10 is then removed together with the netting 12 which is to one side of the spool. The netting 12 is then drawn over the outer surface 14 of the spool 10 so that the netting 12 covers all of the outer surface 14 and extends past the end 15 of the spool 10. Due to its resilience, the netting 12 folds inwardly over the end 15 of the spool 10.

During use, particularly at the initial stages, the net 12 provides a small resistance to withdrawal of the thread 13 from the external surface of the spool 10 so as to prevent any excessive wind-off that might result from rapid withdrawal off the thread 13.

Due to the resilient nature of the netting 12, it will continue to contact the outer surface 14 of the spool 10 to provide the resistance for a substantial reduction in diameter of the spool 10. However, at some point, the diameter of the spool 10 will reduce sufficiently such that the netting 12 will no longer provide a compressive load to the outer surface of the spool 14. However, the netting 12 at this stage still overlies the whole length of the spool 10 and therefore still engages the thread 13 as it is being drawn from the spool 10. As it encapsulates the spool 10, it prevents outward flicking of the thread and therefore minimises excessive thread 13 being drawn off.

Although the preferred embodiment described above covers the whole of the external surface 14 of the spool 10, the invention would still function if only a portion of the outer surface 14 of the spool 10 were covered. For example, the cover may comprise a circumferential band which is positioned at or towards the end of the spool from which the thread is being drawn. This band could be supported via a number of radially spaced cords which extend from the other end of the spool and are attached to the band.

The cover may also comprise a single circumferential thread located at or towards the end of the spool from which the thread is being withdrawn which is also being supported in a similar way by a number of radially spaced longitudinal threads.

The invention described above will minimise the likelihood of excessive thread being drawn off from the spool particularly where the thread is being drawn off intermittently. This will then provide less opportunity for twisting of the thread or otherwise forming loops that will foul or prevent the thread from properly travelling through the feed mechanism. This will be significantly advantageous in machines where any disruption to continuous operation will be disruptive and time consuming therefore reducing the efficiency of the machine and increasing costs of production.

The claims defining the invention are as follows:

1. A restrainer for a spool of thread to prevent the thread from being freely drawn off the spool comprising:

a resilient cover that covers at least an end portion of an outer surface of the spool such that thread being drawn from the spool is passable between the outer surface of the spool and an inner surface of the resilient cover that applies a compressive load to the outer surface of the spool throughout a substantial reduction in diameter of the spool as the thread is drawn off the spool, thereby impeding free removal of the thread.

2. The restrainer according to claim 1 wherein the resilient cover may initially bear against the outer surface of the spool but which may be spaced from the outer surface of the spool after a portion of the thread has been removed from the spool.

3. The restrainer according to claim 1 wherein the resilient cover extends over a whole outer surface of the spool.

4. The restrainer according to claim 1 wherein the resilient cover comprises a polymeric filament.

5. The restrainer according to claim 1 wherein the resilient cover comprises a tubular net.

6. A spool of thread incorporating a restrainer as claimed in claim 1.

7. A restrainer for a spool of thread to prevent the thread from being freely drawn off the spool comprising:

a resilient cover that covers at least an end portion of an outer surface of the spool such that thread being drawn from the spool is passable between the outer surface of the spool and an inner surface of the resilient cover thereby impeding free removal of the thread, wherein the spool of thread is wound onto a central support and a portion of the resilient cover is secured between the thread and the central support.

* * * * *